US008674630B1

(12) United States Patent
Cornelius

(10) Patent No.: US 8,674,630 B1
(45) Date of Patent: Mar. 18, 2014

(54) ON-AXIS RF COUPLER AND HOM DAMPER FOR SUPERCONDUCTING ACCELERATOR CAVITIES

(71) Applicant: Wayne Douglas Cornelius, San Diego, CA (US)

(72) Inventor: Wayne Douglas Cornelius, San Diego, CA (US)

( * ) Notice: Subject to any disclaimer, the term of this patent is extended or adjusted under 35 U.S.C. 154(b) by 0 days.

(21) Appl. No.: 13/694,087

(22) Filed: Oct. 27, 2012

(51) Int. Cl.
*H01J 23/00* (2006.01)

(52) U.S. Cl.
USPC ..... 315/500; 315/501; 315/5.41; 333/195; 333/227; 333/230; 333/232; 333/99 S

(58) Field of Classification Search
USPC ..... 315/5.41, 5.46, 500, 501, 505, 506; 333/195, 115, 206, 227, 230–233, 239, 333/252, 99 S
See application file for complete search history.

(56) References Cited

U.S. PATENT DOCUMENTS

| | | | | |
|---|---|---|---|---|
| 5,319,313 | A * | 6/1994 | Vogel et al. | 315/500 |
| 5,572,092 | A * | 11/1996 | Shrader | 315/5.37 |
| 7,786,675 | B2 * | 8/2010 | Yakovlev et al. | 315/5.39 |
| 7,816,870 | B2 * | 10/2010 | Yakovlev et al. | 315/5.39 |

* cited by examiner

*Primary Examiner* — Haiss Philogene
(74) *Attorney, Agent, or Firm* — William A. Eklund

(57) ABSTRACT

An on-axis rf power coupler for a superconducting particle accelerator includes a coaxial coupler tube that passes through a rf waveguide stub connected to a rf power source. The coupler tube is movable in translation along the axis of the beam path by a piezoelectric drive to permit variation of the coupling between the rf power source and the resonant signal in the accelerator. A tubular rf window extending through the waveguide stub, together with a vacuum bellows assembly connected to the coupler tube, isolate the vacuum inside the accelerator cavity from the vacuum in the rf waveguide and stub. A choke joint in the wall of the waveguide selectively passes unwanted HOM signals out of the waveguide stub and away from the accelerator cavity, where they are dissipated by ferrite tiles on the coupler tube. The upstream end of the coupler tube and a tubular extension of the accelerator cavity form a coaxial line for introducing rf power into the accelerator. Further, the upstream end of the coupler tube separates the rf signal in the cavity from unwanted HOM signals and diverts the latter through the choke joint for isolation and dissipation.

20 Claims, 10 Drawing Sheets

ON-AXIS RF COUPLER AND HOM DAMPER FOR SUPERCONDUCTING ACCELERATOR CAVITIES

CROSS-REFERENCES TO RELATED APPLICATIONS

This application claims the benefit of U.S. Provisional Application No. 61/628,329, filed Oct. 28, 2011.

BACKGROUND OF THE INVENTION

Field of the Invention

The present invention relates to electromagnetic charged particle accelerators. Description of the Related Art Including Information Disclosed Under 37 CFR 1.97 and 37 CFR 1.98

The electromagnetic acceleration of charged particles such as protons, electrons and ions, has practical applications in the fields of medicine, industry, and scientific research, particularly including experimental research in nuclear particle physics. In recent decades, high-energy particle accelerators have been advanced by the use of superconducting technologies to achieve ultra-low electrical resistivity and associated reductions in power losses.

Electromagnetic particle accelerators utilize one or more resonant cavities to accelerate charged particles. Such particles are typically accelerated in bunches as they travel through a series of resonant cavities, each of which accelerates the particles to successively higher velocities by interaction with a resonant radiofrequency (rf) signal present within the cavities.

In order to accelerate a beam of charged particles, the electromagnetic fields associated with a resonant signal inside a cavity must have sufficient magnitude to efficiently transfer energy from the resonating signal into the beam particles. The signals in the cavities are produced by introducing a rf signal into the cavity from a high-powered rf source, which is generally located some distance from the accelerator. The rf signal is transmitted from the rf source to the accelerator via a coaxial transmission line or a waveguide transmission line. At the point where the coaxial transmission line or waveguide joins the accelerator, the rf signal has typically been introduced into the accelerator cavities with a "loop," an "iris," or an electric-field probe, depending on the type of accelerator cavity being used. Introducing the rf signal from the coaxial cable or waveguide into the accelerator cavities is promoted by a device known as a power coupler. One such device is the subject of the present invention.

A power coupler converts the rf signal in the source transmission line into a form that matches the electromagnetic field configuration in the accelerator cavities. Power couplers come in two varieties depending on their interaction with the accelerator cavities. Electric power couplers primarily interact with the electric fields in the cavities. Magnetic power couplers interact primarily with the magnetic fields in the cavities. The choice of coupler depends on the configuration of the accelerator cavities. The rf signal transmitted along the transmission line is transformed by the coupler into either electric field components or magnetic field components, which penetrate the volume of the cavity and introduce energy into the cavity. Because of the resonant nature of the cavity, much of the energy introduced into the cavity is stored in the resonating electromagnetic field in the cavity. As the stored energy increases, the magnitude of the electromagnetic field inside the cavity increases. Thus the cavities become operable to accelerate a beam of particles when these fields reach a sufficient operating level.

Coupling of a rf signal from the source with a resonant rf signal in a cavity is necessary in particle accelerators as well as in other applications. At frequencies above 300 MHz, hollow rectangular waveguides are most often used to transmit a rf power signal from an rf generator into a radiation-shielded area containing the accelerator. The most common method for introducing the rf signal into the accelerator cavities is to connect the rectangular waveguide to a coaxial transmission line that penetrates the vacuum wall and protrudes into the accelerator cavity. Such a transmission line is terminated with a bar that short-circuits the center conductor to the outer wall of the coaxial transmission line, effectively forming a "loop." RF current flowing through the loop produces an rf magnetic field that introduces energy into the accelerator cavity by magnetic field coupling with the resonant magnetic field signal in the cavity. When the magnetic flux density through the loop matches the flux density at the same location in the accelerator cavity, the loop becomes "critically coupled" to the cavity and rf power flows unimpeded from the rf generator through the transmission line and into the accelerator cavity.

Alternatively, a waveguide transmission line can be attached directly to the accelerator cavity. Typically, part of the cross section of the waveguide is occluded with an "iris" to match the electric field magnitude in the waveguide to the electric field magnitude at the same location in the accelerator cavity, which is known as electric field coupling. As with the critical magnetic coupling described above, when the electric field in the iris matches the corresponding electric field inside the accelerator cavity, the rf generator is "critically coupled" to the accelerator cavity, with the result that rf power flows unimpeded from the rf generator through the transmission line and into the accelerator cavity.

Thus in the case of both magnetic and electric field coupling, optimization is achieved when the rf generator is critically coupled to the accelerator, in part because reflection of the rf power signal at the interface is minimized.

However, critical coupling is an unstable condition. Acceleration of charged beam particles transfers energy from an accelerator cavity into the beam, thereby decreasing the energy in the accelerator cavity. In this regard, the energy efficiency of a resonant cavity is typically described by its quality factor (Q), which is defined as the electromagnetic energy stored in the cavity divided by the energy loss per rf cycle (and further in this regard, the operational bandwidth of a resonant cavity at the half-power points on either side of the maximum is equal to the resonant frequency divided by Q). As the energy stored in the cavity is absorbed and thus decreased by the accelerated beam, the ratio of stored electromagnetic field energy to rf drive power decreases. A critically coupled rf drive thus becomes undercoupled because the electromagnetic fields at the interface between the rf power source and the resonant cavity are no longer equal. This inequality, or impedance mismatch, causes rf power to be reflected from the coupler back toward the rf source. This additional loss of drive power further depletes the rf energy stored in the accelerator cavity and further decreases the coupling factor until the rf generator trips off as a result of the high reflected power levels.

This unstable condition is mitigated by deliberately overcoupling the rf drive to the accelerator cavity, or providing slightly more power than is necessary to equalize the flux/fields at the power coupler. When the accelerating beam depletes the stored energy, the match between the rf generator and the accelerator cavity improves and the additional power that was initially reflected in the overcoupled condition enters the accelerator cavity and maintains the stored energy at the desired level. As a practical matter, all accelerator cavities are deliberately "overcoupled" by a small amount in this manner to stabilize their operation. The coupling factor between the rf drive and the accelerator cavities is adjusted by changing the size and/or orientation of the drive loops in the case of magnetic coupling, or by changing the size and/or location of the iris in the case of electric coupling.

A complication with this approach arises with the use of cryogenically cooled superconducting cavities. In particular, the coupling of rf power signals with resonant signals in cryogenically cooled cavities is more challenging than in room-temperature copper cavities. Room-temperature cavities become less stable as the energy stored in the beam approaches the energy stored in the accelerator cavities. Superconducting accelerator cavities, however, are characterized by extremely high unloaded Q values ($\approx 10^{10}$), such that only a few Watts of rf power are needed to produce large accelerating gradients. This low power level required for superconducting cavity excitation is in stark contrast with the one Watt of rf power required to increase the energy of one milliamp of accelerated beam by one keV in a nonsuperconducting cavity. Hence in superconducting systems, the rf power required to accelerate the beam greatly exceeds the rf power needed to maintain the electromagnetic fields in the cavities. It is this contrast, between the energy required to energize superconducting cavities compared with the energy required to energize room-temperature copper cavities, that makes superconducting accelerators extremely efficient, but also complicates the control and stabilization of their operation.

To stabilize the operation of superconducting cavities, the rf power couplers are deliberately and significantly overcoupled to the cavities in order to decrease their effective Q. This decrease in Q increases the operational bandwidth of the accelerator so that the rf source can match the resonant frequency of the cavity. Without the coupler loading the cavity, the operational bandwidth, which is the resonant frequency divided by the Q-factor, required of the rf source would be $\leq 1$ Hz. This bandwidth is well below the capabilities of modern rf sources. Lowering the Q with the power coupler enables matching the rf source to the accelerator cavities. With a significantly overcoupled rf system, most of the rf power is reflected until the accelerating beam depletes the energy stored in the cavities. The optimal coupling factor depends on the accelerating beam current. Hence the coupling factor needs to be adjusted during operation to optimize the transfer of rf energy from the rf power source into the beam.

Beam bunches passing through a superconducting particle accelerator induce electric fields and currents in the metallic walls of the accelerator components, which are generally known as wakefields and image currents. The induced currents can excite unwanted resonant modes in the superconducting cavities. The induced energy associated with such unwanted resonant modes, typically less than a Watt, needs to be removed from the cavity before they accumulate enough stored energy to affect the properties of the beam. The unwanted modes always have higher resonant frequencies than the accelerating mode and can be separated with a frequency filter that passes only the higher-order mode (HOM) frequencies to a resistive component that functions as a damper to absorb and dissipate the induced energy. A variety of HOM dampers have previously been incorporated into superconducting systems. However, previous HOM dampers have been universally mechanically separated from the rf power coupler. This separation requires additional penetrations into the cavity and provides additional locations for problems such as vacuum leaks, contamination, electron multipactor, and high voltage sparking to occur.

The conventional approach to introducing rf power into a superconducting cavity is through a coaxial transmission line that enters the beam tube perpendicular to the axis near the rf cavity. Adjusting the penetration of the center conductor of the coupler into the beam tube changes the coupling factor. An unfortunate side effect of this approach is that the penetrating coaxial line breaks the cylindrical symmetry of the beam tube and can lead to deflection and even disruption of the beam. To address this problem, Veshcherevich et al. described a dual power coupler for the 1300 MHz cavities at Cornell that uses two couplers on opposing sides of the beam tube to minimize the perturbation. This approach reduces the dipole rf field components, but has the disadvantage of potentially introducing quadrupole field components. Dipole rf fields can deflect the beam to one side or the other, or can "shear" the beam envelope by affecting the beam particles on one side in a manner that is different from the effect produced on the other side. Quadrupole fields are generally less disruptive, but can nevertheless affect the focusing of the beam and can shear the beam envelope into four sections. The preferred approach is to maintain the cylindrical symmetry of the superconducting cavities and beam tube.

Most input power couplers reported in the prior art utilize a conventional side-mount configuration. A review of such couplers has been published by A. Variola ("High Power Couplers for Linear Accelerators," in Proc. LINAC06, Knoxville Tenn., 2006, p. 531). Analyses of the performance of, and the problems associated, with side-mount couplers have been published by Jenhani et al. (H. Jenhani, A. Variola, L. Grandsire, T. Garvey, M. Lacroix, W. Kaabi, B. Mercier, C. Prevost, and S. Cavalier, "Studies of Input Couplers for Superconducting Cavities," in Proc LINAC08, Victoria B C, p. 972), and by Kako et al. (E. Kako, H. Hayano, S. Noguchi, T. Shishido, K. Watanabe, and Y. Yamamoto, "High Power Input Couplers for the STF Baseline Cavity System at KEK," in Proc Superconducting RF Workshop, 2007, Bejing China, p. 270).

Kashiwagi et al. make reference to an L-band coupler being fabricated at Fermi National Accelerator Laboratory (S. Kashiwagi, R. Kato, G. Isoyama, H. Hayano, T. Muto, J. Urakawa, and M. Kuriki, "Development of a Photocathode rf Gun for an L-Band Electron LINAC," in Proc. LINAC08, Victoria BC, p 621).

Veshcherevich et al. describe high power testing of the Cornell ERL injector (V. Veshcherevich, S. Belomestnykh, P. Quibleh, J. Reilly, and J. Sears, "High Power Tests of Input Couplers for Cornell ERL Injector," in Proc Superconducing RF Workshop, 2007, Bejing China, p 517), and Veshcherevich and Belomestnykh describe the single-sided input coupler for the main linear accelerator at Cornell. (V. Veshcherevich and S. Belomestnykh, "Input coupler for Main Linac of Cornell ERL," in Proc. Superconducting RF Workshop, 2009, Berlin, Germany, p. 543).

Also, Veshcherevich et al. have reported on the performance of a two-sided coupler system at Cornell (V. Veshcherevich, I. Bazarov, S. Belomestnykh, M. Liepe, H. Padamsee, and V. Shemelin, "A High Power CW Input Coupler for CORNELL ERL Injector Cavities," in Proc. 11$^{th}$ Workshop of RF Superconductivity, Lubeck Germany, 2003, p. 722)

References to on-axis coupler configurations are set forth in the publication of Kunze (M. Kunze, W. F. O. Muller, T. Weiland, M. Brunken, H. -D. Graf, and A. Richter, "Electromagnetic Design of New RF Power Couplers for the S-DALINAC," in Proc. 2004 LINAC Conference, Lubeck Germany, 2004, p. 736); and in the publication by Cee et al. (R. Cee, M. Krassilnikov, S. Setzer, T. Weiland, "Beam Dynamics Simulations for the PITZ rf-Gun," in Proc. EPAC02, Paris, France, p. 1622).

More specifically, Kunze et al. have described twin on-axis coaxial input couplers for the superconducting Darmstadt electron linear accelerator (S-DALINAC) (M. Kunze, W. F. O. Muller, T. Weiland, M. Brunken, H. -D. Graf, and A. Richter, "Electromagnetic Design of New RF Power Couplers for the S-DALINAC," in Proc. 2004 LINAC Conference, Lubeck Germany, 2004, p. 736). The twin waveguide-to-coax transition configuration appears to be working well on the S_DALINAC and on the room-temperature PITZ photocathode rf gun (J. Bahr, I. Bohnet, D. Lipka, H. Ludecke, F. Stephan, Q. Zhao, K. Flottmann, and I. Tsakov, "Diagnostics for the Photoinjector Test Facility in DESY Zeuthen," in Proc. DIPAC 2001, Grenoble France, p. 154).

Sekutowicz, et al. describe a coaxial coupler/higher-order mode (HOM) damper originally developed for HERA, but has since been scaled down and adapted to the TESLA cavities (J. Sekutowicz, "Higher Order Mode Coupler for TESLA," in Proc. $6^{th}$ Workshop on RF Superconductivity, JLAB, Newport News, Va. 1993, p. 426). The configuration of this system is a short coaxial cylinder that "floats" between superconducting cavities. The drive power is coupled to this cylinder via conventional side-couplers and the HOM power is dissipated in a pair of HOM dampers located ~120° from the rf drive coupler. The coupling factor of such a configuration is fixed and cannot be adjusted without breaking the vacuum in the cavity.

Accordingly, it is the object and purpose of the present invention to provide an on-axis rf coupler for a superconducting particle accelerator. More specifically, it is an object and purpose to provide an on-axis rf coupler that does not break the central cylindrical symmetry of a centrally symmetric superconducting accelerator cavity.

It is another object and purpose of the present invention to provide an on-axis rf coupler that also functions to damp and dissipate higher-order-mode (HOM) resonant rf signals that may be induced by a beam passing through a superconducting accelerator cavity.

It is yet another object of the present invention to provide an on-axis coupler that enables the coupling factor to be adjusted during operation so as to optimize the transfer of rf energy from the rf power source into the beam, without requiring that the vacuum in the accelerator cavity be broken.

BRIEF SUMMARY OF THE INVENTION

The present invention provides an on-axis rf power coupler for a superconducting particle accelerator having a superconducting cavity. The coupler includes a rf waveguide stub for receiving an rf power signal transmitted from a rf power source through an rf waveguide. The waveguide stub is operable to convert the rf power signal from a transverse electric mode into a transverse electromagnetic mode. The stub has aligned openings in opposing side walls thereof, which openings are alignable with the axis of a particle beam line of a superconducting particle accelerator. The waveguide stub further includes a ceramic tube that functions as tubular waveguide window, and which connects the aligned openings of the stub walls in sealing relationship and extends coaxially with the beam line.

An electrically conductive coupler tube extends coaxially through the openings in the walls of the waveguide stub and through enclosed the ceramic tube. One end of the coupler tube extends into and is connected to a tubular vacuum bellows assembly affixed to an outside wall of the waveguide stub, preferably the wall of the stub that is downstream with respect to the direction of beam travel. The other end of the coupler tube extends through the opening in the opposite wall of the waveguide stub, and preferably into a conductive vacuum tube that extends from the upstream wall of the stub, and by which the coupler can be connected to a superconducting cavity. The coupler tube and the conductive vacuum tube have diameters that make them collectively function as a coaxial transmission line for transmitting rf power into the accelerator cavity.

The bellows assembly includes a linear drive translator that operates to selectively move the coupler tube in translation coaxially along the axis of the beam line. The power load in the to cavity and the coupling between the rf input signal and the resonant signal in the accelerator cavity can be selectively varied by extension or retraction of the coupler tube, so as to achieve an overcoupled condition, or an undercoupled condition, or a balanced power load condition, and is thereby effective to achieve optimum particle acceleration and energy efficiency and prevention of beam disruptions during operation of the accelerator, without breaking the vacuum of the accelerator cavity or disturbing the central axial symmetry of the particle beam.

In a preferred embodiment the coupler includes a doorknob mode converter in the downstream wall opening of the waveguide stub, which functions to convert the TE mode of the incoming rf power signal into the TEM mode, such that the rf signal can be transmitted coaxially into the accelerator cavity along the movable coupler tube. The coupler also preferably includes a circular rf choke joint formed in the inside circumferential wall of the doorknob converter. The choke joint is sized relative to the exterior surface of the coupler tube so as to pass higher-order-mode (HOM) signals out of the waveguide stub and away from the accelerator cavity, while containing and reflecting lower fundamental rf signals in the accelerator cavity.

In another aspect of the invention, ferrite tiles are attached to the exterior surface of the coupler tube, inside the bellows assembly, such that HOM signals passing through the choke joint and out of the waveguide stub are absorbed and dissipated by the ferrite tiles.

The coupler is preferably oriented with the free end of the coupler tube extending upstream along the beam path toward the accelerator cavity, such that the open end of the coupler tube separates out HOM signals for isolation, absorption and dissipation by the ferrite tiles, without disrupting the particle beam inside the coupler tube.

The power coupler of the present design maintains the cylindrical symmetry of the system and shields the beam from the non-symmetric perturbations produced by the waveguide. In addition, the HOM damper is an integral part of the power coupler so that additional connections to the superconducting cavities are not required. The rf electric field from the end of the coupler tube of the coaxial line couples directly into the electric field inside the accelerator cavity. The distance from the end of the coupler tube to the inside wall of the superconducting cavity determines the coupling factor from the coupler into the cavity. Adjusting this distance changes the coupling factor and can be used to optimize the performance of the accelerator. The required coupling depends on several dynamic factors and real-time adjustment is a considerable advantage compared with non-adjustable couplers.

BRIEF DESCRIPTION OF THE SEVERAL VIEWS OF THE DRAWINGS

The accompanying Figures are incorporated in and form a part of this specification. In the Drawings.

The accompanying drawings illustrate the construction and function of the present invention particularly when taken with the followed detailed description of the invention.

DETAILED DESCRIPTION OF THE INVENTION

Figure 1:
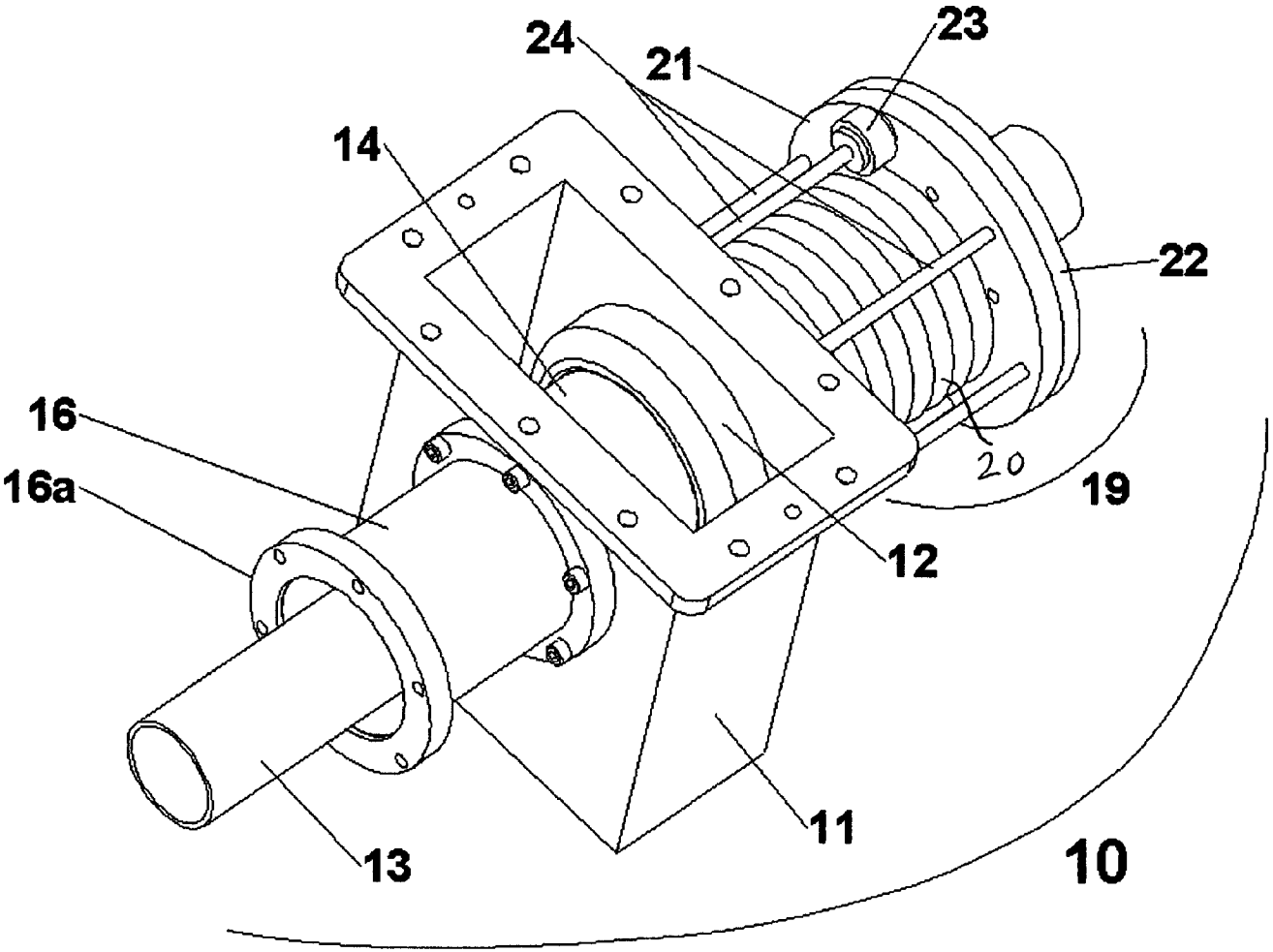
FIG. 1 is an isometric view of a preferred embodiment of the basic rf coupler of the present invention.
Figure 2:
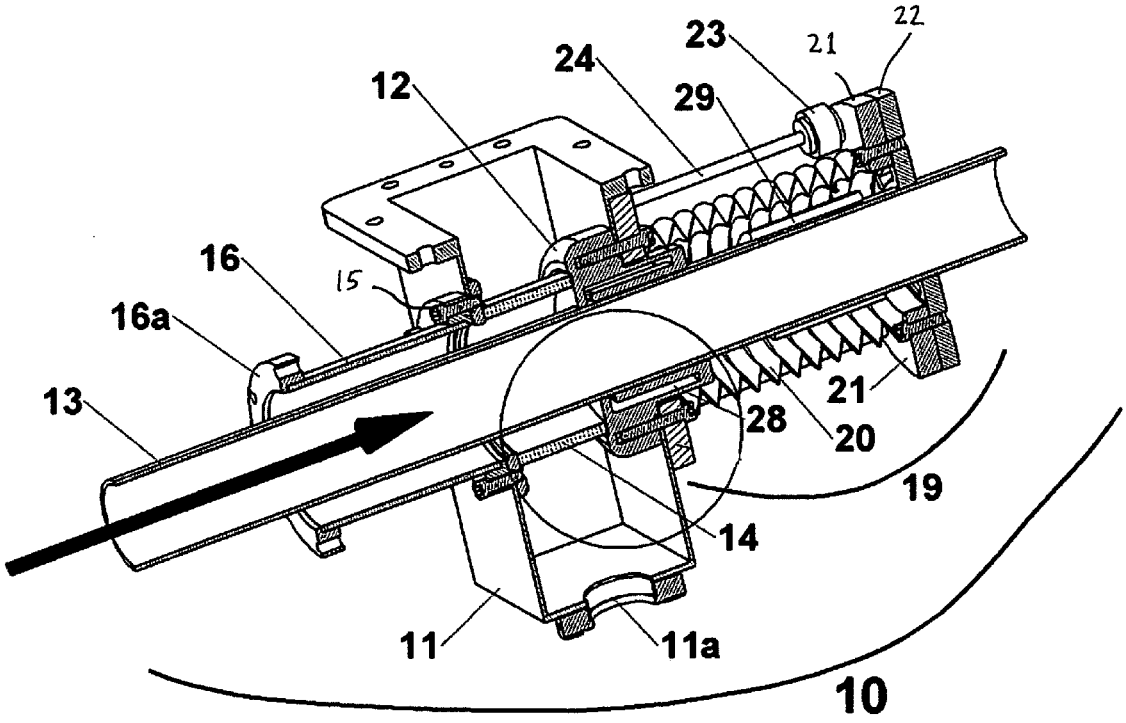
FIG. 2 is an isometric view in cross section of the coupler shown in FIG. 1.

FIGS. 1 and 2 illustrate a preferred embodiment of a basic on-axis coupler and higher-order-mode (HOM) damper 10 constructed in accordance with the present invention, and referred to below simply as the coupler 10. The coupler 10 is intended for installation in a superconducting particle accelerator. The coupler 10 functions to both introduce rf power into the accelerator and to also damp and dissipate HOM signals generated by the passage of charged particles through the accelerator.

In the description that follows, orientations and positions of various elements are in some cases described with respect to the common longitudinal axis of the coupler 10 and the accelerator cavity to which the coupler is attached, and by reference to the direction of flow of the accelerated particles along such axis, i.e., as either the downstream direction or the upstream direction. In the accompanying Figure the direction flow of the particle beam is shown by arrows.

Referring to FIGS. 1 and 2, power is introduced into the coupler 10 by means an rf signal that is produced by a conventional rf power source (not shown) and transmitted through a hollow rf waveguide (also not shown) into a conventional WR-650 waveguide stub 11. In the waveguide stub 11 the mode of the incoming rf signal is converted from the transverse electric (TE) waveguide mode into a coaxial transverse electromagnetic (TEM) mode by a circular, electrically conductive "doorknob" mode converter 12 that is installed in an opening in a downstream wall of the waveguide stub 11.

The doorknob mode converter 12 surrounds, and is coaxial with, an electrically conductive coupler tube 13, preferably made of copper, which extends through opposing upstream and downstream side walls of the waveguide stub 11. Coupler tube 13 is movable in translation axially therein, as further described below, passing through the doorknob converter 12.

Both the waveguide stub 11 and the accelerator cavity to which it is attached (not shown in FIGS. 1 and 2) are normally evacuated. The vacuum space inside the waveguide stub 11 is isolated from the vacuum space inside the particle accelerator by a nonconductive ceramic tube 14 that surrounds and is coaxial with coupler tube 13 and which spans the waveguide stub 11. One end of ceramic tube 14 abuts and is sealed to the doorknob converter 12 in the waveguide stub 11. The other end of ceramic tube 14 abuts and is sealed to a circular pass-through 15 located in the opposite wall of waveguide stub 11. A coaxial conductive metallic vacuum tube 16 extends from the pass-through 15 on the outside of the waveguide stub 11. Vacuum tube 16 includes a flange 16*a* for connection to an accelerator cavity 17 (FIG. 6), as described further below.

Both the ceramic tube 14 and the vacuum tube 16 are significantly larger in diameter than the coupler tube 13, such that the coupler tube 13 and the vacuum tube 16 form a coaxial rf transmission line that functions to transmit rf power from the waveguide stub 11 upstream to the accelerator cavity 17. Briefly, translational movement of the coupler tube 13 changes the loading of the accelerator cavity 17, so as to either introduce power into, or withdraw power from, accelerator cavity 17.

The position of the coupler tube 13 is adjustable by a bellows assembly 19 that may be expanded or contracted so as to move the coupler tube 13 along its axis, in translation relative to the stationary waveguide stub 11 and the stationary accelerator cavity 17. The coupler tube 13 is thus movable and positionable in both directions along the common axis of the coupler 10 and the accelerator cavity 17. As described further below, the bellows assembly 19 enables the coupler tube 13 to be selectively moved and positioned relative to the waveguide stub 11 and the accelerator cavity 17 so as to adjustably couple the incoming rf power signal with a resonant rf signal in the accelerator cavity 17.

Still referring to FIGS. 1 and 2, bellows assembly 19 includes a flexible stainless steel cylindrical vacuum bellows 20, the downstream or movable end of which is connected and sealed to a circular bellows flange 21. The upstream end of bellows 20 is connected and sealed to the outside of doorknob converter 12.

The downstream end of coupler tube 13 is connected to a coupler flange 22 (also shown in FIG. 5) that is affixed coaxially to movable bellows flange 21, and by which the coupler 13 is thus movable in translation along the central axis of the coupler 10 and the accelerator cavity 17 with expansion and contraction of bellows 20.

The movable bellows flange 21, the attached coupler flange 22, and the coupler tube 13 are all driven in axial translation by a commercially available linear piezoelectric drive translator 23 that connects the bellows flange 21 to the waveguide stub 11. Commercially available piezoelectric translators are simple, robust, and compatible with high vacuum environments, cryogenic operations, and class-100 clean-room standards. In addition, such piezoelectric drives have micron-level position resolution over many centimeters of travel.

The flanges 21 and 22 are guided and supported by a set of four rigid guide rods 24, which extend from the downstream wall of the waveguide stub 11 and which are parallel to the axis of the coupler 10 and the accelerator cavity 17. Guide rods 24 thus also function to support and guide the coupler tube 13 as it is driven in translation through the walls of the waveguide stub 11.

Coupler tube 13 is entirely supported by the guide rods 24 and flanges 21 and 22, such that it passes through both walls of the waveguide stub 13 without making contact with the interior surfaces of either the surrounding doorknob converter 12 or pass-through 15.

In this regard, the diameter of pass-through 15 is significantly larger than that of the coupler tube 13, so as to enable the coupler tube 13 and the vacuum tube 16 to function as a coaxial rf transmission line. However, the inside diameter of the doorknob converter 12 is only slightly larger than the outside diameter of coupler tube 13, so as to permit installation of a choke joint 28 that is effective to damp and dissipate HOM signals.

Figure 2A:
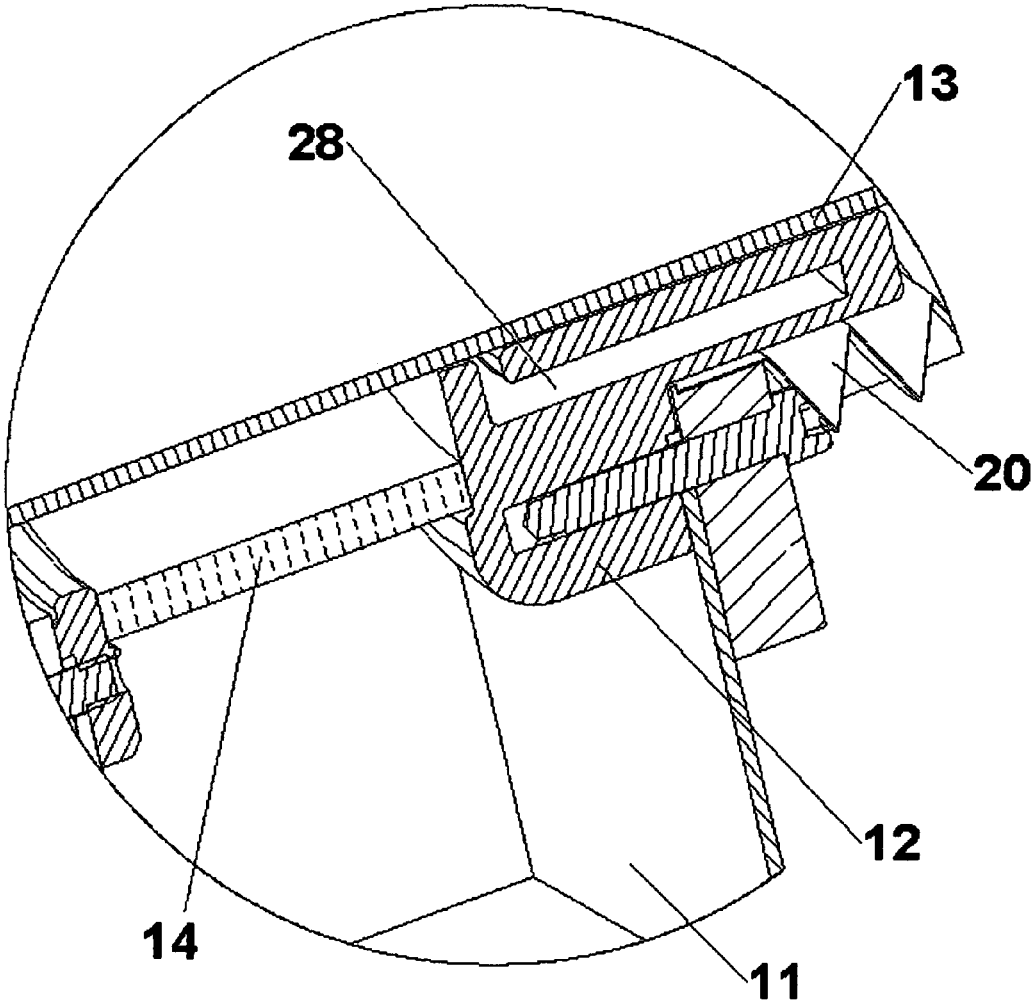
FIG. 2*a* is a magnified view of the area shown as encircled in FIG. 2.

Choke joint 28 is illustrated in FIG. 2*a*, which is a magnified view of the circled portion of FIG. 2. The outside surface of coupler tube 13 is spaced slightly from the inner surface of the doorknob converter 12, and thus the interior volume of bellows 20 is in communication with the vacuum space of accelerator cavities both upstream and downstream from the coupler 10. In this regard, and referring to the enlarged view in FIG. 2*a*, a nominal outside diameter for an exemplary coupler tube 13 is on the order of two inches, while the annular clearance between the coupler tube 13 and the doorknob converter 12 is on the order of 1/16 inch. These relative dimensions are selected to enable the operation of a quarter-wave rf choke joint 28, which is formed on the inside surface of the opening of doorknob converter 12. Choke joints are well known in the art. The choke joint 28 has a length equal to one-quarter the wavelength of the fundamental frequency of the rf signal in the cavity 17, so that rf signals are reflected from the choke joint 28 and create an open-circuit condition at the open end of the choke joint 28. This forces rf energy at the fundamental frequency to have an electric-field maximum at that point. The choke joint 28 only affects those frequencies with an open-circuit condition at the open end of the choke joint 28. Since the vast majority of HOMs are not resonant, they pass the choke joint 28 unimpeded. Thus the choke joint 28 functions to pass HOM rf signals emanating from wake-field effects in the upstream accelerator cavity into the bellows assembly 19; while at the same time reflecting the lower fundamental frequency rf signals.

Also as a consequence of the coupler tube 13 passing freely through the walls of the waveguide stub 11, the interior of the coupler tube 13 and the annular volume surrounding it, as well as the space between the bellows 20 and the coupler tube 13, are in communication with one another as well as with the vacuum space of the accelerator cavity 17, which in the case of superconducting accelerators must normally be maintained at a vacuum on the order $10^{-9}$ torr and must also be maintained at or near class-10 clean room particulate cleanliness levels. However, the interior volume of the waveguide stub 11 is isolated from the vacuum space within the accelerator cavity 17 by ceramic tube 14, such that the vacuum space of the accelerator cavity 17 is isolated from that of the waveguide stub 17, which is evacuated through port 11*a*.

FIGS. 1 and 2 illustrate the basic structure of a coupler 10 that is effective to adjustably couple a rf power source to a resonant accelerator cavity, without breaking the central symmetry of the structures surrounding the beam path, which is a particularly desirable feature of superconducting accelerator cavities, and while also absorbing and dissipating unwanted HOM signals. However, additional implementing structure is useful where it desirable to isolate the clean, high vacuum environment inside a superconducting accelerator cavity from the relatively "dirty" vacuum that is typically present outside the cavity as a result of the cryogenic cooling of the cavity.

Figure 3:
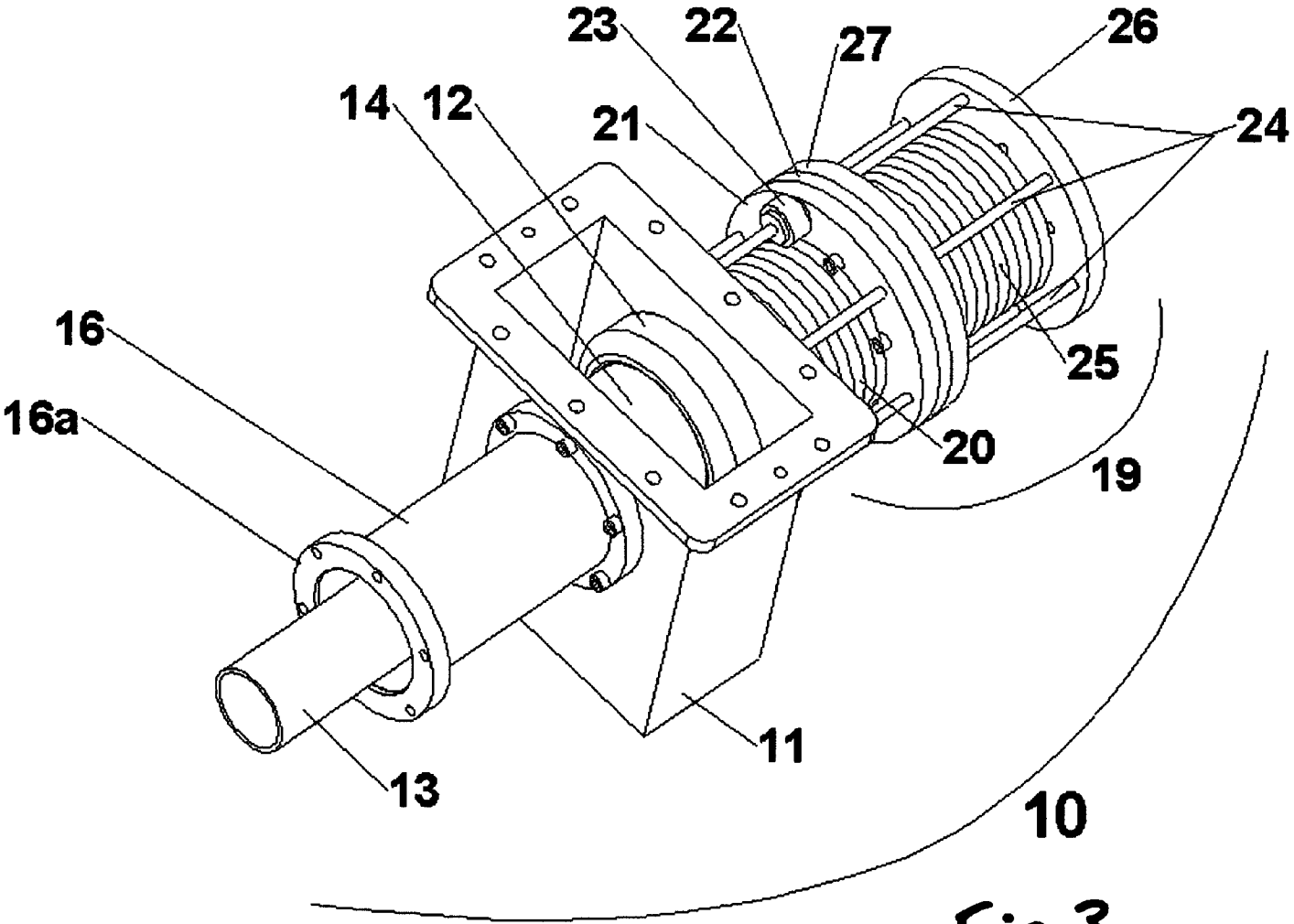
FIG. 3 is an isometric view of the coupler of FIGS. 1 and 2, with the addition of a second bellows to enable installation of the coupler into an accelerator assembly requiring maintenance of the accelerator cavity vacuum conditions both upstream and downstream from the coupler.
Figure 4:
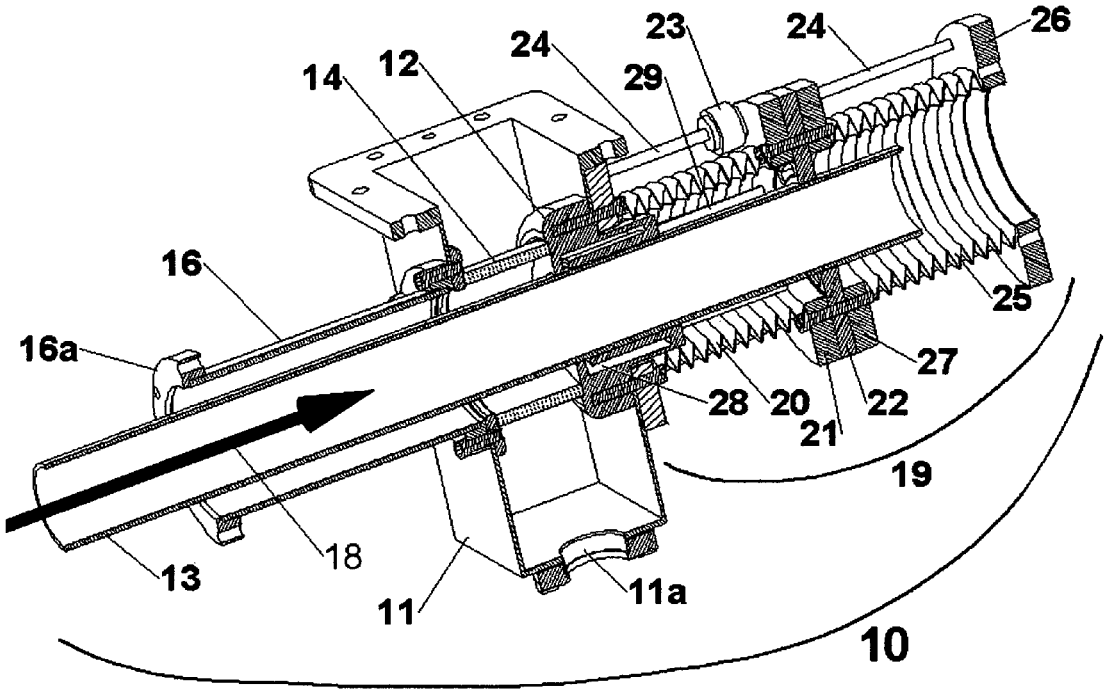
FIG. 4 is an isometric view in cross section of the embodiment shown in FIG. 3, including an enlarged view showing the choke joint employed between the doorknob and the coupler tube.

Thus FIGS. 3 and 4 illustrate the coupler 10 with the addition of a second bellows 25 and associated second bellows flanges 26 and 27. In the structure shown in FIGS. 3 and 4, the coupler tube flange 22, together with bellows flanges 21 and 27, travel along extended guide rods 24. In all other regards the structure and function of the coupler 10 shown in FIGS. 3 and 4 are identical to those of the coupler shown in FIGS. 1 and 2; and like elements of the coupler 10 shown in FIGS. 1 and 2 are numbered identically with the corresponding elements of the coupler 10 shown in FIGS. 3 and 4.

The second bellows 25 shown in FIGS. 3 and 4, and particularly the fixed flange 26 that is affixed to the ends of guide rods 24, enables the coupler 10 to be installed between fixed elements of adjacent accelerator cavities, or between a single accelerator cavity and another device such as a target chamber, by attachment of flange 16*a* to one accelerator cavity and by attachment of second bellows flange 26 to the other accelerator cavity or device. This also enables the coupler tube 13 to be moved axially in translation within the coupler 10, while also enabling the vacuum spaces of the accelerator cavities or other devices to which the coupler 10 is attached to be in fluid communication with one another through the bellows 20 and 25, the ceramic tube 14, and vacuum tube 16. Thus the continuous vacuum space connecting adjacent accelerator cavities or devices is isolated from the lower quality vacuum space outside the coupler 10, and is also isolated from the vacuum space of the rf power supply and the waveguide stub 11, as further described below.

Figure 5:
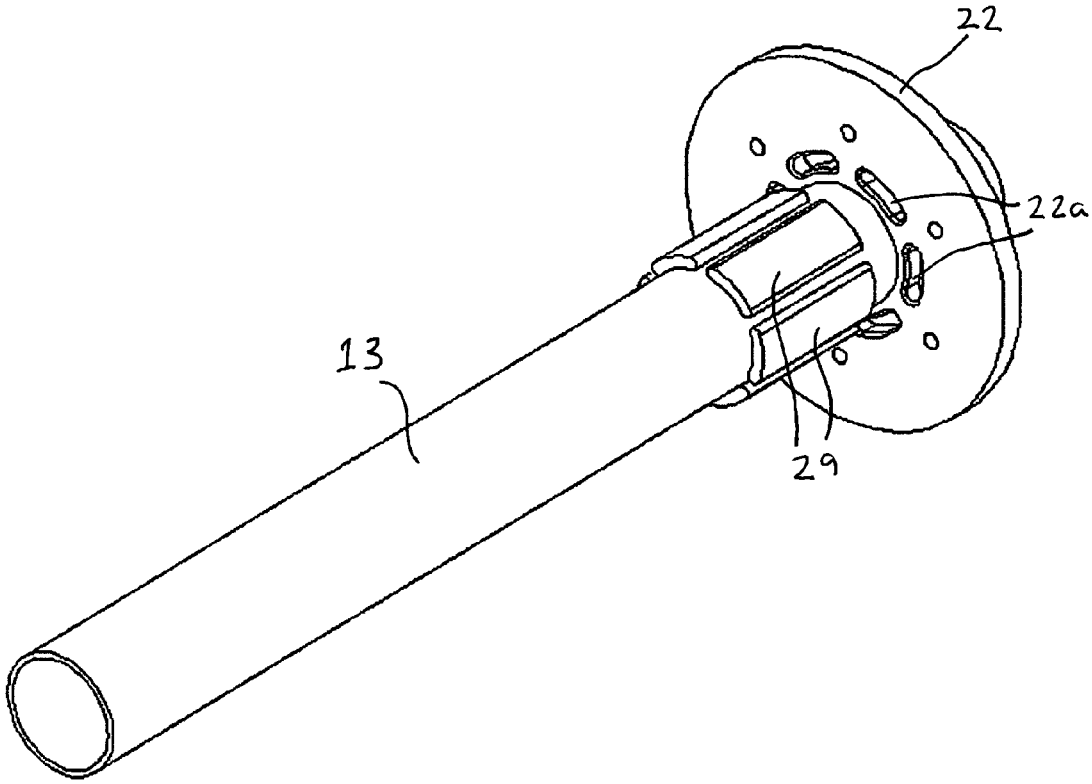
FIG. 5 illustrates the configuration of the coupler tube of the couplers shown in FIGS. 1 through 4, illustrating the attached ferrite tiles used to absorb the HOM signals.

Referring to FIG. 5, the conductive coupler tube 13 includes six ferrite tiles 29 spaced circumferentially around and affixed to its outer surface, adjacent to coupler flange 22. The ferrite tiles 29 function as HOM dampers that absorb and dissipate the energy of HOM signals passing through choke joint 28. A number of different ferrites and other materials are suitable as power absorbers for the HOMs. These materials provide a resistive circuit to the HOM rf power and dissipate the energy as heat. This heat is ultimately transferred to the surrounding cryogenic liquid helium by thermal conduction through the metal structures. FIG. 5 also illustrates ports 22*a* formed in the coupler tube flange 22, which allow fluid communication between the vacuum spaces upstream and downstream from the coupler tube 13 and its flange 22.

Figure 6:
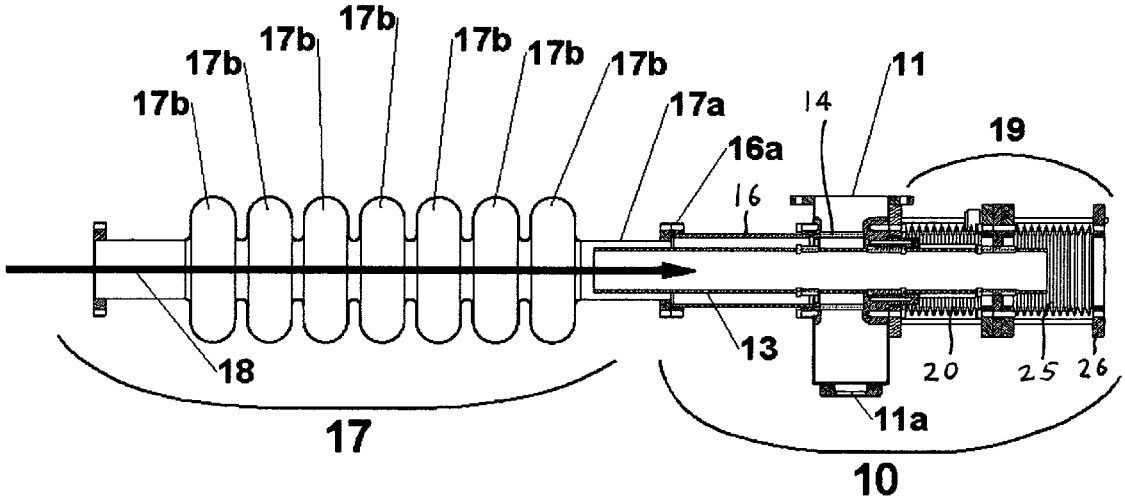
FIG. 6 is a side view in partial cross section of the coupler shown in FIGS. 3 and 4, as installed on-axis in an accelerator having a seven-cell superconducting cavity.

FIG. 6 illustrates the coupler 10, including second bellows 25 shown in FIGS. 3 and 4, as installed downstream from a superconducting accelerator cavity 17. The cavity 17 is connected to vacuum tube flange 16*a* of coupler 10 by means of a cavity extension tube 17*a*. The illustrated exemplary accelerator cavity 17 shown in FIG. 6 includes seven resonant cells 17*b* integrally connected in series.

Figure 7A:
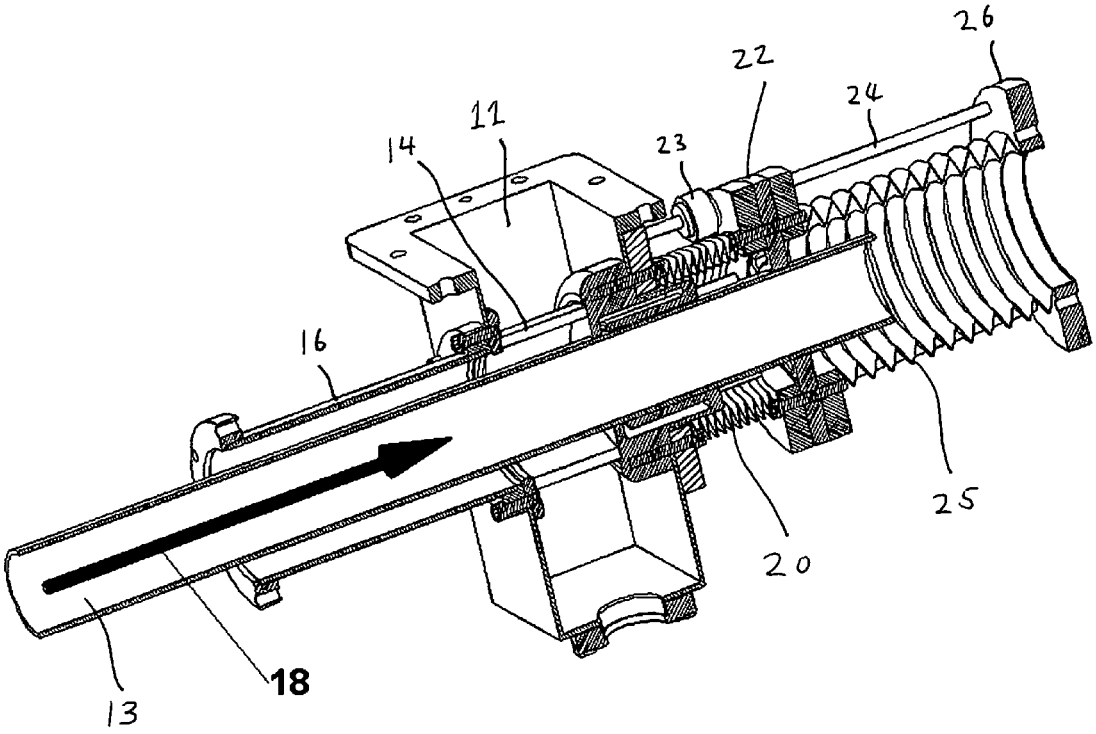
FIGS. 7*a* and 7*b* illustrate the coupler of FIGS. 3 and 4 with the coupler tube shown in its maximum and minimum penetration positions, respectively.
Figure 7B:
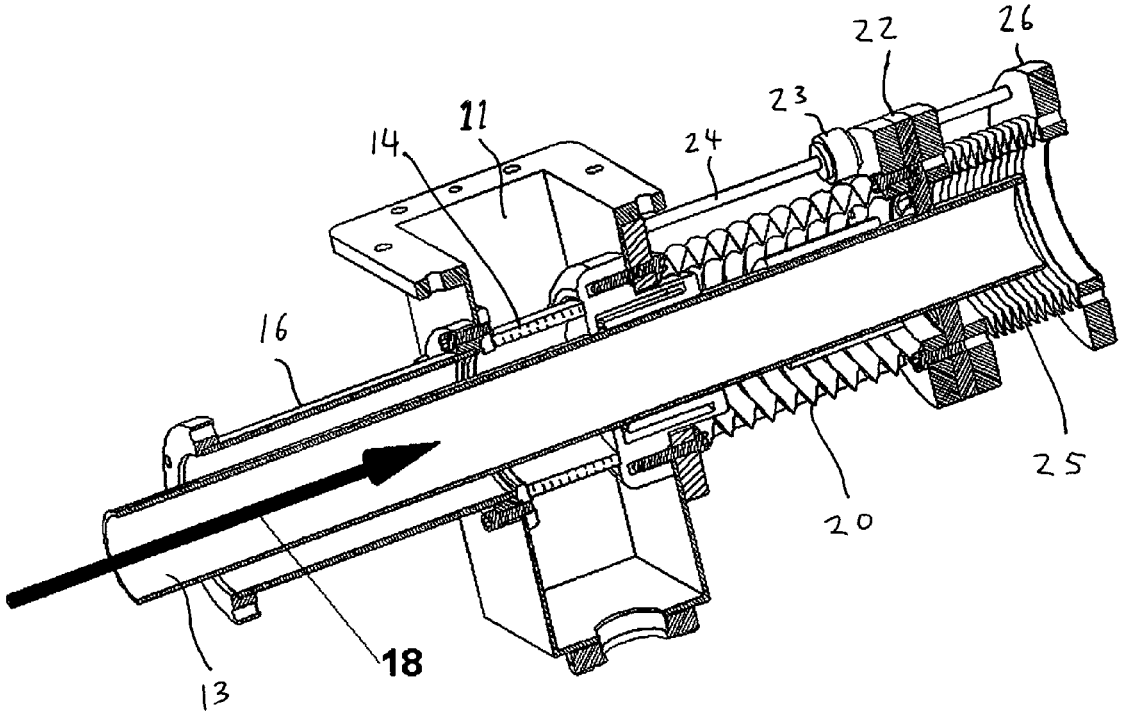

FIGS. 7*a* and 7*b* show the coupler 10 of FIGS. 3 and 4 with its coupler tube 13 at its maximum and minimum penetration depths, respectively. The penetration depth of the coupler tube 13 determines the coupling factor between the on-axis coupler 10 and an adjacent superconducting cavity 17. Thus the coupling of the rf power source to the superconducting cavity 17 can be dynamically adjusted during operation by activation of the linear drive translator 23, without breaking vacuum or disrupting the central axial symmetry of the beam. FIGS. 7*a* and 7*b* also illustrate the alternating compression and expansion of the two bellows 20 and 25, as the coupler tube 13 travels back and forth along its axis.

Figure 8:
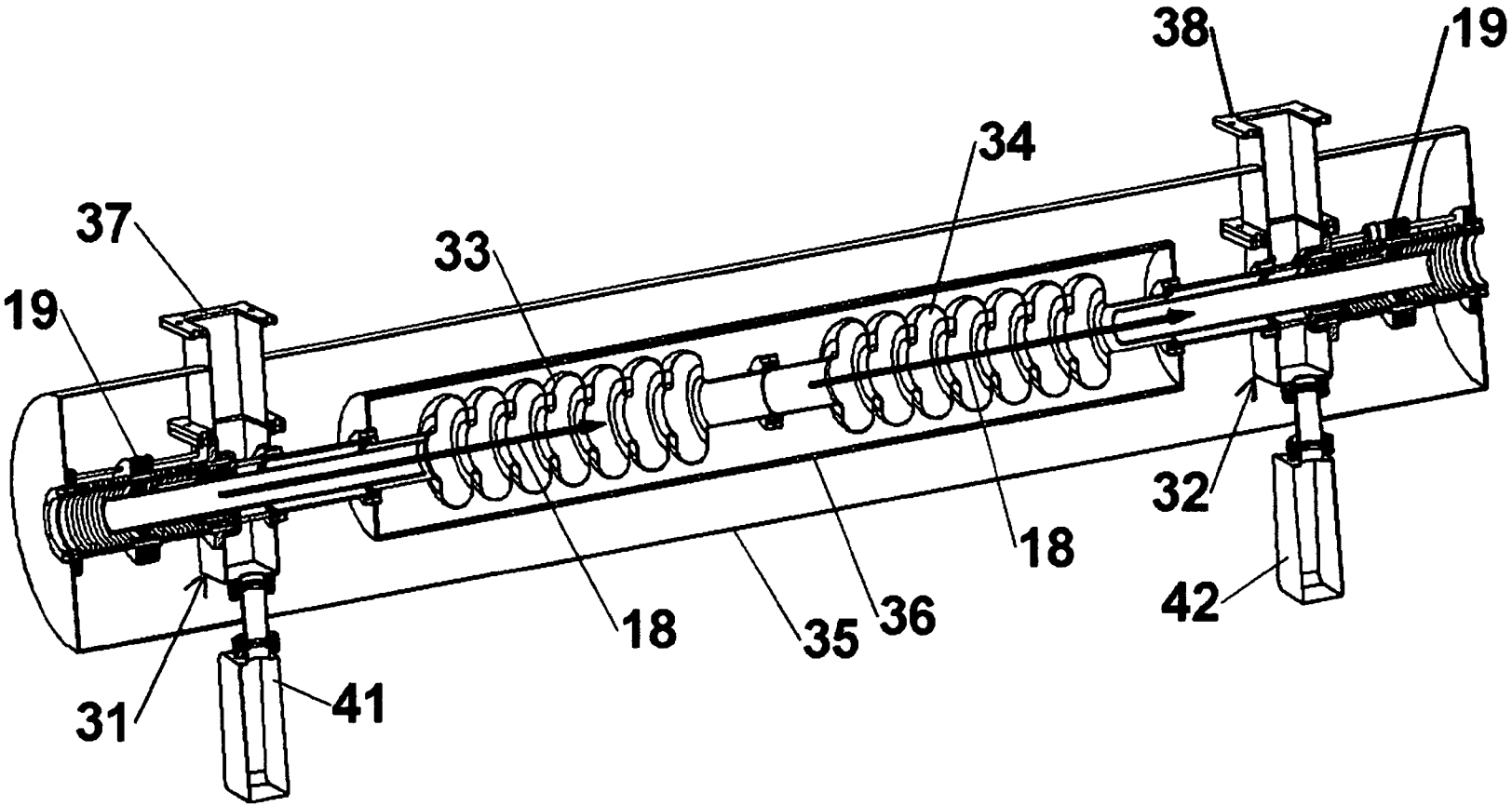
FIG. 8 shows two couplers, as shown in FIGS. 3 and 4, installed in a cryostat assembly having two seven-cell accelerator cavities in series.

FIG. 8 shows two on-axis rf couplers, 31 and 32, each constructed in accordance with the present invention as shown in FIGS. 3 and 4, as attached to two superconducting cavities 33 and 34, respectively. Cavities 33 and 34 are connected in series, with the couplers 31 and 32 and cavities 33 and 34 all being contained within a single cryostat assembly that includes a vacuum vessel 35. The superconducting cavities 33 and 34 are immersed in liquid helium contained inside a liquid helium vessel 36, which is in turn maintained in a vacuum contained within vacuum vessel 35, thereby insulating the liquid helium vessel from ambient temperatures.

The rf couplers 31 and 32 are shown as being attached to opposite ends of cavities 33 and 34, respectively, but one of these couplers could be mounted in the center, between the two cavities, rather than at the ends as shown in FIG. 8.

Two segments of WR-650 waveguide, 37 and 38, penetrate the vacuum tank 35 and connect to the associated waveguide stubs of the couplers 31 and 32. Ion pumps 41 and 42 evacuate the waveguide stubs of couplers and 31 and 32, respectively. The direction of the particle beam is denoted by arrow 18. The couplers 31 and 32 include vacuum bellows assemblies 19 that are the same as that shown in FIGS. 3 and 4, for connection to upstream and downstream accelerator components such beam sources, target chambers or additional accelerator cavities.

Referring particularly to FIGS. 1 through 7, during operation a rf power signal is transmitted from a rf power supply (not shown), through a conventional waveguide (also not shown), and into the WR-650 waveguide stub 11. There the mode of the rf signal is converted from the TE mode that exists in the waveguide into a TEM mode that is transmitted along the outside of the coupler tube 13 and into the accelerator cavity 17 via vacuum tube 16 and cavity extension tube 17*a*. The incoming rf power signal and the resonant signal in the accelerator cavity 17, which are at or near the lower fundamental frequency of the accelerator cavity, are prevented from passing in the opposite direction, through the doorknob mode converter 12 and into the bellows assembly 19, by the quarter-wave rf choke joint 28, while HOM signals pass through the choke joint 28 and are absorbed by the ferrite tiles 29 attached to the coupler tube 13.

The depth of penetration of the coupler tube 13 into the accelerator cavity 17 is adjusted by moving flange 21 in the axial direction by action of the piezoelectric linear translator 23, over the range of motion indicated by FIGS. 7*a* and 7*b*. The vacuum bellows 20 and 25 enable free axial motion of the coupler tube 13 relative to the center of the waveguide stub 11, which thereby enables selective adjustment of the electrical loading of the accelerator cavity 17 while preserving the high vacuum of the accelerator cavity 17 and maintaining it in communication with components located downstream from the accelerator.

It should be noted that FIG. 6 shows the on-axis coupler 10 as installed with the free end of the coupler tube 13 extending "upstream" against the direction of travel of the accelerated particles, that is, with the beam particles traveling in the direction of arrow 18 and entering the free end of the coupler tube 13. The "cookie-cutter" geometry of the free end of the coupler tube 13 opening into the accelerator cavity 17, at the center of FIG. 6, reduces wakefield effects as the beam passes from the larger-diameter extension tube 17*a* of the accelerator cavity 17 into the relatively smaller-diameter coupler tube 13. With such an arrangement electromagnetic wakefields produced by the charged particle beam are neatly sliced off by the open end of the coupler tube 13. Electromagnetic fields inside the coupler tube 13 are relatively unaffected by this process, resulting in little or no the disturbance of the particle beam as the wakefields are removed. The HOM electromagnetic fields outside the coupler tube 13 travel along the annular volume between the coupler tube 13 and the cavity extension tube 17*a* and vacuum tube 16, and into the waveguide stub 11 inside ceramic tube 14. There the HOM frequency components pass by the choke joint 28 and are absorbed by the ferrite tiles 29 (FIG. 5). Field energy at the fundamental rf drive frequency is conducted out of the system through the WR-650 waveguide. Further, the coupler tube 13 functions to shield the particle beam from disturbance by HOM signals that may be present in the waveguide stub 11, as they pass through the coupler tube 13.

A key feature of present invention is the quarter-wave rf choke joint 28 in the doorknob converter 12. The radial gap between coupler tube 13 and the surrounding doorknob converter 12, which is necessary to the operation of the choke joint 25, also functions to eliminate physical contact between the movable coupler tube 13 and the doorknob mode converter 12. Eliminating physical contact between the sliding surfaces of these components eliminates the potential for producing metallic dust that could migrate into the superconducting rf cells and compromise their performance. Thus choke joint 28 operates to reflect the fundamental rf mode while passing unwanted HOM modes to the ferrite tiles 29, and additionally reduces the potential for sparking and erosion of metal components.

It is also important to note that the choke joint 28 is effective primarily over the fundamental accelerator frequency range commonly used in superconducting accelerators, for example the 1500 MHz frequency employed in certain Jefferson Laboratory accelerator cavities and the 1300 MHz frequency proposed for the proposed International Linear Collider cavities. HOM signals have frequencies higher than these fundamental frequencies and thus pass readily through the choke joint. The thermal contact between the ferrite tiles and the coupler tube 13 ensures a low thermal resistance path so as to keep the ferrite tiles 29 cool.

The geometry of the coupler design is also compatible with cryogenic operation. As shown in FIG. 8, the coupler may be installed in a vacuum chamber that insulates one or more liquid-helium cooled accelerator cavities, while the waveguide stub of the on-axis coupler may be independently evacuated by a separate vacuum pump.

The coupler 10 of the present invention readily operates at the low temperatures of around 2 degrees K typically maintained in superconducting accelerator cavities. The thermal break between the surrounding room temperature and the cryogenic temperatures maintained is typically located in the rf waveguide upstream of the WR-650 waveguide stub 11 shown in the Figures. This approach separates the problem of minimizing thermal loads from the problem of maximizing thermal conductance to maintain low operating temperatures.

Finally, it will be noted that the vacuum system inside the ceramic tube 14 of the coaxial coupler 10 and superconducting cavity 17 is separated from the vacuum system of the waveguide stub 11 by ceramic tube 14. In this regard, the coupler 10 is fed rf power through a conventional WR-650 waveguide and associated rf window (not shown), located upstream of the waveguide stub 11, so that the stub 11 can be evacuated to very low pressures comparable to those in an adjacent accelerator. As a result, the cylindrical ceramic tube 14 need not support the vacuum of the superconducting cavity against ambient air pressure, enabling its thickness to be minimized. Minimizing the thickness of the ceramic tube 14 minimizes rf power losses and hence also minimizes the thermal management issues that often plague other window designs. Additionally, any dust or debris associated with connecting or disconnecting the waveguide and/or waveguide window falls to the bottom of the waveguide stub 11 and does not contaminate the beam vacuum or the superconducting cavity cells 17*b*.

It should also be noted that the coupler 10 may be installed in an accelerator such that beam particles travel in a direction through the coupler 10 that is opposite from the direction illustrated and explained above with respect to FIGS. 1 through 7. As shown in FIG. 8, for example, coupler 31 is shown with the free end of the coupler tube 13 extending in the downstream direction, while the free end of the coupler 32 is shown in the upstream direction.

In general the configuration of coupler 32, as also shown in FIGS. 1 through 7, is the more désirable configuration because the cookie-cutter wakefield control explained above is most effective using that configuration. However, the contrary orientation, of coupler 31 in FIG. 8, is also an acceptable configuration in certain accelerator systems that are less sensitive to beam disruption from wakefields. In either case, energy produced by the beam particles exciting HOMs in the superconducting cavities is coupled out of the cavities and transported along the coupler tube 13 to the ferrite tiles 29, where it is absorbed and dissipated.

The important features of the on-axis rf coupler of the present invention include: 1) a conventional cylindrical rf window, 2) on-axis variable rf coupling, 3) a choke joint that passes HOM signals while eliminating sliding contacts that could produce metallic dust), 4) an integral HOM damper with sufficient thermal contact to cooled surfaces, 5) cookie-cutter geometry to control wakefields, 6) a dual window design (a tubular ceramic window in conjunction with waveguide window), and 7) a high-precision linear insertion drive mechanism.

The on-axis rf coupler of the present invention offers significant improvements in the operation of superconducting accelerators. Variable on-axis coupling preserves the cylindrical symmetry of the beamline and the accelerator cavity and associated resonant cells, while simultaneously enabling a large in situ variation of the coupling factor between the rf source and the superconducting cavity. The geometry of the on-axis coupler is well suited to installation in a cryogenic container and maintains isolation of the beamline vacuum from the rf waveguide vacuum, thereby preventing contamination of accelerator cavities during installation and maintenance.

A number of factors will be addressed in the ordinary course of the detailed design of the coupler, all of which are within scope of one ordinary skill in the art of rf superconducting accelerator design and engineering. These factors include: 1) the efficient conversion of waveguide TE-mode energy into TEM coaxial energy with minimal reflected power and minimal conversion into undesired modes, 2) the electrical, mechanical, and thermal design of the tubular ceramic window, 3) the detailed design of the choke-joint, 4) issues associated with cryogenic design and thermal management, 5) the design of the mechanical support and motion control of the coupler tube, 6) efficient collection and safe dissipation of HOM energy, and 7) the elimination of the propensity for electron multipacting that often plagues superconducting accelerator systems.

Multipacting describes the process where a single electron can be accelerated by the rf fields and impact the metallic walls of the structure either in the same location as originally emitted or in another location. Each electron impact has the potential to liberate other electrons whose eventual impact liberates still more electrons in an avalanche process. Large numbers of impacting electrons can absorb a significant amount of rf energy and deposit that energy in a relatively concentrated location. Absorption of rf energy decreases the energy available for accelerating the beam. Also, depositing such energy in a concentrated location can quickly destroy the superconductivity at the metal surface, causing the cavity to "quench" and thereby lose all superconductivity. When a quench occurs, the rf power source must be turned off before the cavity is permanently damaged.

The design of the transition from WR-650 waveguide to a coaxial transmission line is a critical part of the overall design, particularly since the system operates at 2° K. The final coupler design is a compromise between the rf design, mechanical and thermal design, and the potential for electron multipacting.

It will also be noted that the coupler tube 13 extends some distance from its mounting flange 22 and thus a sound mechanical design is essential to maintain the rigidity of the coupler tube 13, to ensure that it remains precisely aligned with the beam path and does not contact the doornknob converter 12, particularly when being moved in translation by linear translator 23. This may addressed in part by counterweighting of the coupler tube 13 by extending its length beyond the coupler tube flange 22, as shown for example in FIGS. 2 and 4.

A sound thermal design is also essential if the system is to operate reliably at 2° K. Not all of the features required for isolating the cryogenic components from the ambient temperatures are shown in the Figures. Others that will be apparent to one skilled in the art of cryogenic design may be utilized.

The present invention is described and illustrated herein by reference to a preferred embodiment and the best mode known to the inventor. However, various alterations, substitutions and modifications that may be apparent to one of ordinary skill in the art may be made without departing from the essential invention. Accordingly, the scope of the present invention is defined by the following claims.

The invention claimed is:

1. An on-axis radiofrequency coupler for a particle accelerator having a superconducting cavity comprising:

a radiofrequency (rf) waveguide stub operable to receive an rf power signal transmitted through an rf waveguide from a rf power source, said waveguide stub being operable to convert the mode of said rf power signal from a transverse electric (TE) mode into a transverse electromagnetic (TEM) mode, said stub having first and second aligned openings in first and second opposing side walls thereof, respectively, which openings are alignable with the axis of a particle beam line of a superconducting particle accelerator cavity, said waveguide stub further including a ceramic tube connecting said openings in sealing relationship and extending coaxially with said beam line;

an electrically conductive coupler tube having first and second ends, said coupler tube extending coaxially through said openings in said opposing walls of said waveguide stub and through said ceramic tube, said first end of said coupler tube extending into and being connected to a tubular vacuum bellows assembly affixed to the outside of said first wall of said waveguide stub and centered on said first opening, said bellows assembly including a linear drive translator operable to selectively move said coupler tube in translation coaxially along said axis of said beam line;

said coupler tube being sized and positioned such that said second end of said coupler tube penetrates a tubular electrically conductive extension of said superconducting cavity by a variable distance determined by the actuation of said drive translator, such that said coupler tube and said tubular extension function as a coaxial transmission line to introduce said rf power signal into said accelerator cavity, and whereby the electromagnetic load in said cavity can be selectively balanced to achieve optimum particle acceleration and energy efficiency.

2. The coupler defined in claim 1 further comprising a circular doorknob mode converter affixed to and centered on said first opening of said first wall of said waveguide stub, said converter being operable to convert the mode of said rf power signal from a transverse electric (TE) mode into a transverse electromagnetic (TEM) mode, and said converter being sized to accommodate translational axial movement of said coupler tube through said converter without said coupler tube contacting said converter.

3. The coupler defined in claim 1 wherein said waveguide stub includes a circular rf choke joint in said first wall, which is sized and positioned relative to the exterior surface of said coupler tube so as to pass higher-order-mode (HOM) signals through out of said waveguide stub and away from said accelerator cavity, while blocking lower frequency power rf signals present in said stub and in said accelerator cavity.

4. The coupler defined in claim 2 wherein said waveguide stub includes a circular if choke joint in an interior circumferential surface of said circular doorknob mode converter, said choke joint being sized and positioned relative to the exterior surface of said coupler tube so as to pass higher-order-mode (HOM) signals through said waveguide stub and out of said waveguide stub and away from said cavity, while blocking lower frequency fundamental rf signals in said stub and in said accelerator cavity.

5. The coupler defined in claim 4 wherein said choke joint is a quarter-wave choke joint.

6. The coupler defined in claim 5 further comprising a plurality of ferrite tiles attached to said coupler tube at a position on said coupler tube within said bellows assembly, said ferrite tiles being operable to absorb and dissipate HOM signals passed through said choke joint from said waveguide stub.

7. The on-axis radiofrequency coupler defined in claim 1 wherein said tubular vacuum bellows assembly includes first and second tubular vacuum bellows aligned coaxially with one another in series, said bellows each having a first end and a second end, said first end of said first bellows being connected to said first wall of said waveguide stub, and said first end of said coupler tube having a flange to which said second end of said first bellows is affixed to, said flange of said coupler tube having ports which place the annular volumes surrounding said coupler tube within said first and second bellows in fluid communication with one another;

said first end of said second tubular vacuum bellows being also connected to said first end of said coupler tube and said second end of said first bellows;

said second end of said second tubular vacuum bellows being affixed to a plurality of rigid guide rods extending from said outside first wall of said waveguide stub coaxially with said axis of said beam line;

said second end of said first vacuum bellows and said first end of said second tubular vacuum bellows being affixed to one another, and both being slidably mounted on said guide rods and connected to said linear translator, by which said coupler tube is movable in translation axially to vary the loading of said accelerator cavity and alternately expand and contract said first and second bellows; and whereby the space inside said coupler tube as well as the annular spaces outside said coupler tube and within said bellows assembly are in fluid communication with the vacuum maintained in said accelerator cavity.

8. The coupler defined in claim 7, wherein said bellows assembly is affixed at one end to said first wall of said waveguide stub, and is affixed at its opposite end to said first end of said coupler tube, and wherein said coupler tube includes a plurality of ferrite tiles attached to the exterior surface thereof adjacent said first end of said tube, whereby HOM signals passing through said choke joint and out of said waveguide stub are absorbed and dissipated by said ferrite tiles.

9. The on-axis radiofrequency coupler defined in claim 8 wherein said drive translator is a piezoelectric drive translator.

10. An on-axis radiofrequency coupler for a particle accelerator having a superconducting cavity comprising:

a radiofrequency (rf) waveguide stub for receiving an rf power signal transmitted through an rf waveguide from a rf power source, said waveguide stub being operable to convert said rf power signal from a transverse electric mode into a transverse electromagnetic mode, said stub having first and second aligned circular openings in first and second opposing side walls thereof, respectively, which openings are alignable with the axis of a particle beam line of a superconducting particle accelerator, said waveguide stub including a circular rf choke joint in said first wall, and said waveguide stub further including a ceramic tube connecting said openings in sealing relationship and extending coaxially with said beam line;

an electrically conductive coupler tube having first and second ends, said coupler tube extending coaxially through said openings in said opposing walls of said waveguide stub and through said ceramic tube, said choke joint being sized and positioned relative to the exterior surface of said coupler tube so as to pass higher-order-mode (HOM) signals out of said waveguide stub and away from said accelerator cavity, while blocking lower frequency power rf signals resonant in said stub and in said accelerator cavity said coupler tube extending into and being connected to a tubular vacuum bellows assembly affixed to the outside of said first wall of said waveguide stub and centered on said first opening, said bellows assembly including a linear drive translator operable to selectively move said coupler tube in translation coaxially along said axis of said beam line;

said coupler tube being sized and positioned such that said second end of said coupler tube penetrates a tubular electrically conductive extension of said superconducting cavity by a variable distance determined by actuation of said drive translator, such that said coupler tube and said tubular extension function as a coaxial transmission line to introduce said rf power signal into said accelerator cavity, and whereby the electrical loading in said cavity can be selectively balanced to achieve optimum particle acceleration and energy efficiency.

11. The on-axis radiofrequency coupler defined in claim 10, wherein said bellows assembly is affixed at one end to said first wall of said waveguide stub, and is affixed at its opposite end to said first end of said coupler tube, and wherein said coupler tube includes a plurality of ferrite tiles attached to the exterior surface thereof adjacent said first end of said tube, whereby HOM signals passing through said choke joint and out of said waveguide stub are absorbed and dissipated by said ferrite tiles.

12. The on-axis radiofrequency coupler defined in claim 10, further comprising a circular doorknob mode converter embedded in said first opening said first wall of said waveguide stub, and wherein said choke joint is a circumferential choke joint formed in the interior circumferential surface of said waveguide stub.

13. The on-axis radiofrequency coupler defined in claim 12 wherein said choke joint is a quarter-wave choke joint.

14. The on-axis radiofrequency coupler defined in claim 13 wherein said tubular vacuum bellows assembly includes first and second tubular vacuum bellows aligned coaxially with one another in series, said bellows each having a first end and a second end, said first end of said first bellows being connected to said first wall of said waveguide stub, and said first end of said coupler tube having a flange to which said second end of said first bellows is affixed to, said flange of said coupler tube having ports which place the annular volumes surrounding said coupler tube within said first and second bellows in fluid communication with one another;

said first end of said second tubular vacuum bellows being also connected to said first end of said coupler tube and said second end of said first bellows;

said second end of said second tubular vacuum bellows being affixed to a plurality of rigid guide rods extending from said outside first wall of said waveguide stub coaxially with said axis of said beam line;

said second end of said first vacuum bellows and said first end of said second tubular vacuum bellows being affixed to one another, and both being slidably mounted on said guide rods and connected to said linear translator, by which said coupler tube is movable in translation axially to vary the loading of said accelerator cavity and alternately expand and contract said first and second bellows; and whereby the space inside said coupler tube as well as the annular spaces outside said coupler tube and within said bellows assembly are in fluid communication with the vacuum maintained in said accelerator cavity.

15. The coupler defined in claim 13 further comprising a conductive vacuum tube extending outwardly from said second opening in said second wall of said waveguide stub coaxially with said axis of said beam line, and wherein the interior diameter of said vacuum tube is sufficiently larger than the outside diameter of said coupler tube that said vacuum tube and said coupler tube passing therethrough function as a coaxial transmission line for transmitting power into said accelerator cavity in the TEM mode.

16. An on-axis radiofrequency coupler for a particle accelerator having a superconducting cavity comprising:

a radiofrequency (rf) waveguide stub for receiving an rf power signal transmitted through an rf waveguide from a rf power source, said waveguide stub being operable to convert said rf power signal from a transverse electric mode into a transverse electromagnetic mode, said stub having first and second aligned circular openings in first and second opposing side walls thereof, respectively, which openings are alignable with the axis of a particle beam line of a superconducting particle accelerator, said waveguide stub including a circular rf choke joint in said first wall, and said waveguide stub further including a ceramic tube connecting said openings in sealing relationship and extending coaxially with said beam line;

an electrically conductive coupler tube having first and second ends, said coupler tube extending coaxially through said openings in said opposing walls of said waveguide stub and through said ceramic tube, said choke joint being sized and positioned relative to the exterior surface of said coupler tube so as to pass higher-order-mode (HOM) signals out of said waveguide stub and away from said accelerator cavity, while blocking lower frequency power rf signals resonant in said stub and in said accelerator cavity said coupler tube extending into and being connected to a tubular vacuum bellows assembly affixed to the outside of said first wall of said waveguide stub and centered on said first opening, said bellows assembly including a linear drive translator operable to selectively move said coupler tube in translation coaxially along said axis of said beam line;

said coupler tube being sized and positioned such that said second end of said coupler tube penetrates a tubular electrically conductive extension of said superconducting cavity by a variable distance determined by actuation of said drive translator, such that said coupler tube and said tubular extension function as a coaxial transmission line to introduce said rf power signal into said accelerator cavity, and whereby the electrical loading in said cavity can be selectively balanced to achieve optimum particle acceleration and energy efficiency.

17. The on-axis radiofrequency coupler defined in claim 16, further comprising a circular doorknob mode converter embedded in said first opening of said first wall of said waveguide stub, and wherein said choke joint is a circumferential choke joint formed in the interior circumferential surface of said waveguide stub.

18. The on-axis radiofrequency coupler defined in claim 17 wherein said coupler tube and said doorknob converter are sized such that the difference between the exterior diameter of said coupler tube and the interior diameter of said circumferential choke joint is sufficiently large so that the vacuum space within said bellows assembly is in communication with that of said accelerator cavity and said coupler tube does not contact said choke joint during axial translation, yet is sufficiently small so that HOM signals are passed through said choke joint while the fundamental rf signal of said accelerator cavity is blocked and reflected by said choke joint.

19. The on-axis radiofrequency coupler defined in claim 18 wherein said choke joint is a quarter-wave choke joint.

20. The on-axis radiofrequency coupler defined in claim 19 wherein said tubular vacuum bellows assembly includes first and second tubular vacuum bellows aligned coaxially with one another in series, said bellows each having a first end and a second end, said first end of said first bellows being connected to said first wall of said waveguide stub, and said first end of said coupler tube having a flange to which said second end of said first bellows is affixed to, said flange of said coupler tube having ports which place the annular volumes surrounding said coupler tube within said first and second bellows in fluid communication with one another;

said first end of said second tubular vacuum bellows being also connected to said first end of said coupler tube and said second end of said first bellows;

said second end of said second tubular vacuum bellows being affixed to a plurality of rigid guide rods extending from said outside first wall of said waveguide stub coaxially with said axis of said beam line;

said second end of said first vacuum bellows and said first end of said second tubular vacuum bellows being affixed to one another, and both being slidably mounted on said guide rods and connected to said linear translator, by which said coupler tube is movable in translation axially to vary the loading of said accelerator cavity and alternately expand and contract said first and second bellows; and whereby the space inside said coupler tube as well as the annular spaces outside said coupler tube and within said bellows assembly are in fluid communication with the vacuum maintained in said accelerator cavity.

* * * * *